US005293758A

United States Patent [19]

Ames et al.

[11] Patent Number: 5,293,758

[45] Date of Patent: Mar. 15, 1994

[54] OUTSIDE SECTION FOR SPLIT SYSTEM AIR CONDITIONING UNIT

[75] Inventors: David Ames; Stephen Bartlett, both of London, England; Darrell D. Beitel; Carl Bergt, both of Tyler, Tex.; Alain R. Parmentier, Darnieulles; Andre Vivarie, Dogneville, both of France

[73] Assignee: American Standard Inc., New York, N.Y.

[21] Appl. No.: 752,117

[22] Filed: Aug. 29, 1991

[51] Int. Cl.[5] ..... F25D 17/06

[52] U.S. Cl. ..... 62/428; 62/263; 62/508; 312/101; 312/236

[58] Field of Search ..... 62/262, 263, 428, 508; 165/122; 312/101, 236

[56] References Cited

U.S. PATENT DOCUMENTS

| | | | |
|---|---|---|---|
| 2,401,560 | 6/1946 | Graham et al. | 62/262 |
| 3,199,580 | 8/1965 | Vaughn | 165/122 |
| 3,296,820 | 1/1967 | Bauman | 62/263 |
| 3,301,003 | 1/1967 | Laing | 62/428 |
| 3,714,795 | 2/1973 | Fowell et al. | 62/508 |
| 3,805,541 | 4/1974 | Hosoda et al. | 62/262 |
| 4,554,796 | 11/1985 | Stankard | 62/326 |
| 4,723,419 | 2/1988 | Kessler et al. | 62/507 |
| 4,733,542 | 3/1988 | Blair | 62/263 |
| 4,733,543 | 3/1988 | Blair | 62/263 |
| 4,736,598 | 4/1988 | Sameshima et al. | 62/259.1 |

FOREIGN PATENT DOCUMENTS

| | | | |
|---|---|---|---|
| 0149833 | 8/1985 | Japan | 62/262 |
| 0181528 | 9/1985 | Japan | 62/262 |

OTHER PUBLICATIONS

Trane Brochure A 70 CA 003 U.

*Primary Examiner*—John M. Sollecito
*Attorney, Agent, or Firm*—William J. Beres; William O'Driscoll; Peter D. Ferguson

[57] ABSTRACT

An outside section for a split system air conditioning unit. The outside section has a housing including a first side, a second side, a top, a bottom, a front, and a back. The housing also includes an air inlet located in a middle portion of the front, and an air outlet located in the first side. A first baffle divides the housing interior into first and second segments. The first segment includes the air inlet, the air outlet and a heat exchange coil located therebetween, and the second segment includes a compressor operably connected to the heat exchange coil.

7 Claims, 3 Drawing Sheets

OUTSIDE SECTION FOR SPLIT SYSTEM AIR CONDITIONING UNIT

BACKGROUND OF THE INVENTION

The present invention is directed to split system air conditioning systems, and more particularly, to the arrangement of an outdoor section of a split system air conditioning system. In a split air conditioning system, an indoor section containing a heat exchanger is located in an environment to be conditioned, and refrigerating conduit connects that indoor section to an outdoor section containing an outside heat exchanger and a compressor. Split systems are particularly advantageous for residential use and are favored over window air conditioning units because the separation of the compressor and the outdoor heat exchanger from the indoor heat exchanger results in a substantially quieter air conditioning unit.

Previous outdoor sections typically require a propeller type fan blowing air through the outdoor section from front to back, or vice versa. This front-to-back arrangement produced a bulky design which lacks aesthetic appeal and which cannot be wall mounted without blocking airflow due to airflow clearance requirements. These minimum clearance requirements are at least two inches (5.9 cm) on the back side of the previous outdoor section with further clearance requirements of at least two inches (5.9 cm) of clearance on one side wall and at least ten inches (25.45 cm) of clearance on the other side wall. Additionally, the prior art units have at least ten inches (25.45 cm) or more of depth in addition to the two inches (5.9 cm) of back clearance.

Additionally, the combination of a compressor and a heat exchange coil within the outdoor section results in the transmission of compressor vibrations and noise into the environment to be cooled by means of the outside heat exchange coil and the conduit connecting that coil to the inside section.

SUMMARY OF THE INVENTION

It is an object, feature and advantage of the present invention to solve the problems of prior art split system air conditioning units.

It is an object, feature and advantage of the present invention to provide an outdoor section for a split system air conditioning unit having aesthetic appeal.

It is an object, feature and advantage of the present invention to provide an outdoor section for a split system air conditioning unit having a low depth profile.

It is an object, feature and advantage of the present invention to provide and outdoor section for a split system air conditioning unit having a compressor which is acoustically isolated from the outside heat exchange coil.

It is an object, feature and advantage of the present invention to provide an outdoor section for a split system air conditioning unit having minimal profile.

It is an object, feature and advantage of the present invention to provide an outdoor section for a split system air conditioning unit having minimal depth.

It is an object, feature and advantage of the present invention to provide an outdoor section for a split system air conditioning unit with a low length to depth ratio.

It is an object, feature and advantage of the present invention to provide an outside section for a split system air conditioning unit having a middle air inlet.

It is an object, feature and advantage of the present invention to provide an outside section for a split system air conditioning unit having an airflow path including mid entry and side discharge.

It is an object, feature and advantage of the present invention to provide an outside section for a split system air conditioning unit which has been ergonomically designed for consumer enjoyment.

It is an object, feature and advantage of the present invention to provide an airflow path through the outside section of a split system air conditioning unit where the airflow at the air inlet is at approximately right angles to the airflow at the air outlet.

The present invention provides an outside section for a split system air conditioning unit. The outside section has a housing including a first side, a second side, a top, a bottom, a front, and a back. The housing also includes an air inlet located in a middle portion of the front, an air outlet located in the first side, and a first baffle dividing the housing interior into first and second segments. The first segment includes the air inlet, the air outlet and a heat exchange coil located therebetween, while the second segment includes a compressor operably connected to the heat exchange coil.

The present invention also provides an outside section for a split system air conditioning unit. The outside section has a housing including first and second interior segments separated by an acoustical baffle. The first segment includes an air inlet, an air outlet, and a heat exchange coil therebetween. The second segment includes a compressor operably connected to the heat exchange coil.

The present invention further provides an outside section for a split system air conditioning unit. The outside section has a housing including an air inlet, an air outlet, a fan, a compressor, and a heat exchange coil. The housing also has a height, a width and a depth, where the ratio of the width to the depth of the housing is greater than 2.2.

The present invention additionally provides an outside section for a split system air conditioning unit. The outside section has a housing including a back, a front, a top, a bottom, a first side and a second side. The first side includes an air outlet substantially extending between the top and the bottom. The front includes a recessed air inlet substantially extending between the top and the bottom. The back, the bottom and the second side do not include airflow apertures.

The present invention also provides a split system outdoor section for an air conditioning system. The outside section includes a housing having a front, a side and a back. The front defining a recessed louvered inlet, the side defines a louvered outlet and the back is solid so as to permit said outdoor section to be placed immediately adjacent a wall without interfering with airflow through the housing. The outside section includes a heat exchanger coil interposed between the louvered front inlet and the louvered side outlet. The outside section also includes a vertically standing tangential blower for inducing airflow through the coil. The blower is disposed adjacent the louvered outlet so as to deliver air for discharge from the housing along the entire vertical length of the louvered outlet.

The present invention further provides an outside section for a split system air conditioning unit including:

a housing; a compressor located in the housing; a heat exchange coil located in the housing; an air inlet in the housing; an air outlet in the housing; and an airflow path through the housing, the airflow path includes the air inlet, the air outlet and the heat exchange coil, and the airflow path enters the air inlet at approximately right angles to the airflow path at the air outlet.

DETAILED DESCRIPTION OF THE DRAWINGS

Figure 1:
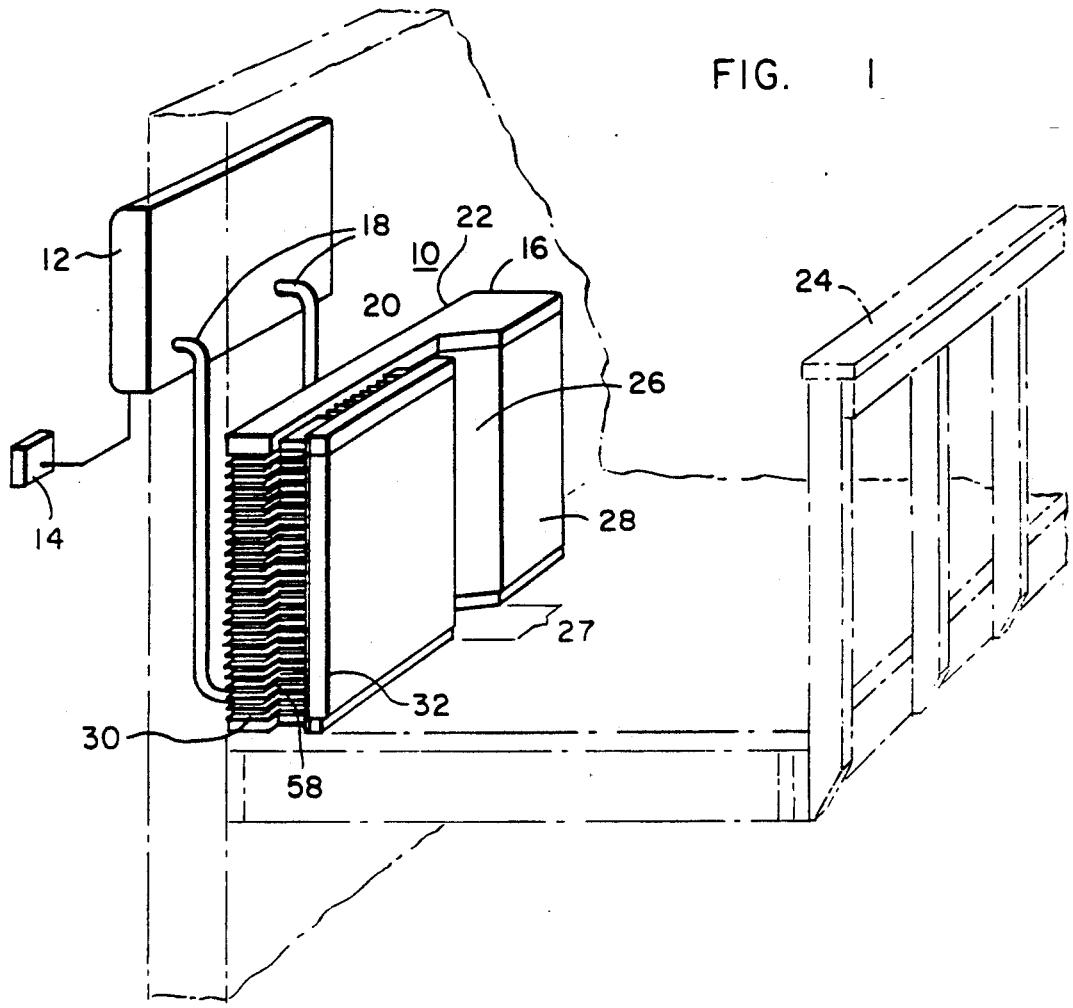
FIG. 1 shows the arrangement of a split system air conditioning unit.

FIG. 1 shows the general arrangement of a split system air conditioning unit 10 including an inside section 12 having an inside heat exchange coil (not shown), and a thermostat 14 for controlling the operation of the split system unit 10. The split system unit 10 also includes an outside section 16 connected to the inside section 12 by refrigerant conduit 18. The outside section 16 is suitable for mounting on an exterior wall 20 because there are no air inlets or outlets on a back 22 of the outside section 16 which can be blocked by the wall 20. Thus the back 22 does not require a minimum clearance between the back 22 and an external surface. Additionally, the low profile and ergonomic design of the outside section 16 make the outside section 16 suitable for installation on an outside living space such as a balcony 24. The outside section 16 includes an air inlet 26 located in a middle portion 27 of the front 28 of the outside section 16, and an air outlet 30 located on a first side 32 of the outside section 16. Since the air inlet 26 is at approximately right angles to the air outlet 30, the outside section 16 can be mounted with both the back 22 of the outside section 16 and a second side 36 of the outside section 16 flush in a corner of an exterior wall 20.

Figure 2:
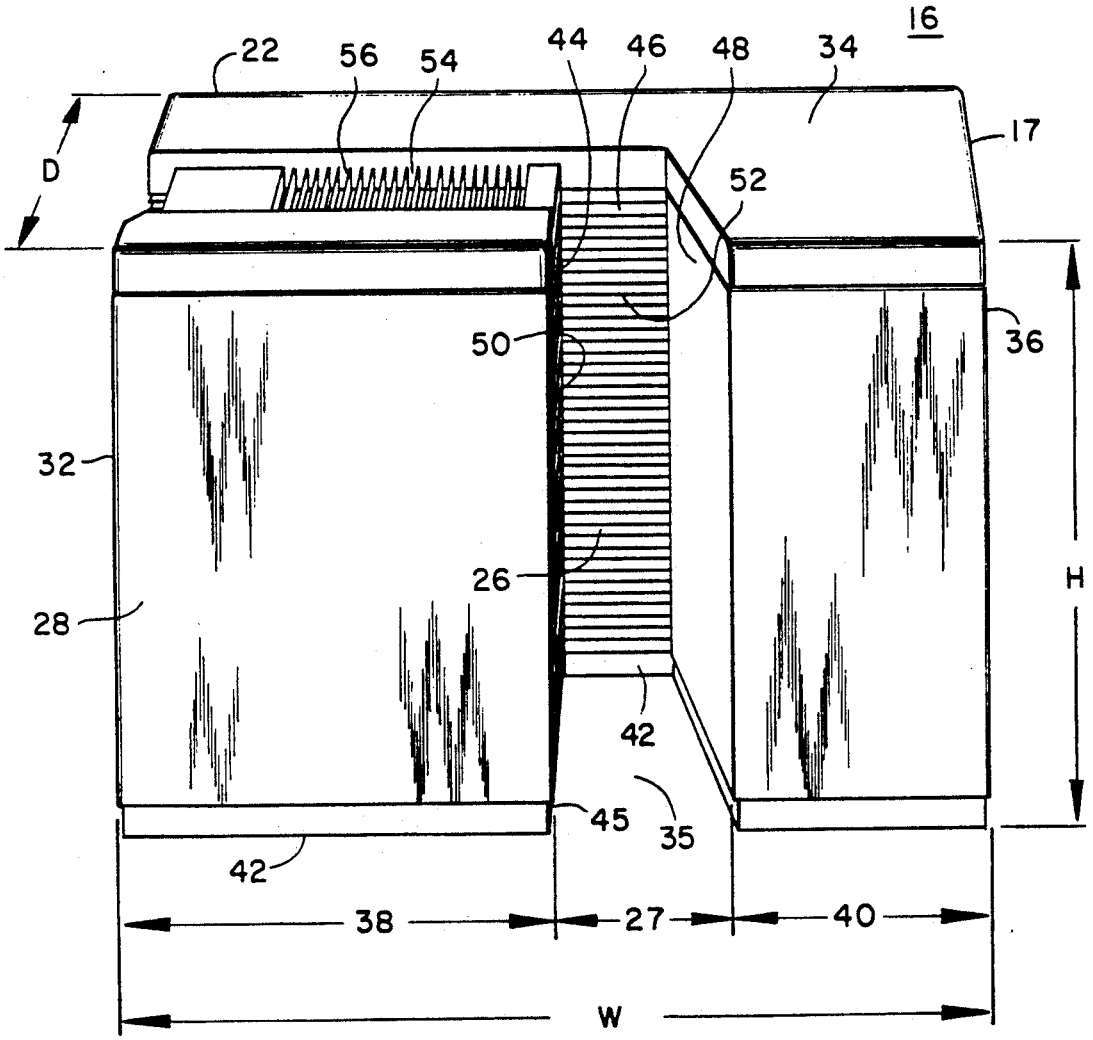
FIG. 2 shows a perspective view of an outside section of the split system air conditioning unit of FIG. 1.

Referring now to FIG. 2, the outside section 16 has a housing 17 which includes the back 22, the front 28, and the first side 32 and also includes a bottom 42, a top 34, and the second side 36. The front 28 is divided by the air inlet 26 into a first portion 38 and a second portion 40. The air inlet 26 itself is a recess 35 substantially extending from the top 34 of the outside section 16 to the bottom 42 of the outside section 16. The recess 35 preferably has three sides 44, 46, 48, none of which are parallel to each other. The sides 44 and 46 are adjacent and at right angles to each other. The sides 44 and 46 of the recess 35 allow airflow into the outside section 16 and include louvers 50 and 52 respectively, while the side 48 does not allow airflow but acts as an air director so as to funnel air to the sides 44, 46. The first portion 38 of the front 28 may extend over an end 45 of the side 44 so as to protect the air inlet 26. Additionally, the first side 32 includes a tiered louver 58 over the air outlet 30 substantially extending from the top 34 to the bottom 42 of the outside section 16. Optionally, the top 34 may include a top air intake 54 including louvers 56. The second side 36, the back 22, and the bottom 42 do not include airflow apertures.

Figure 4:
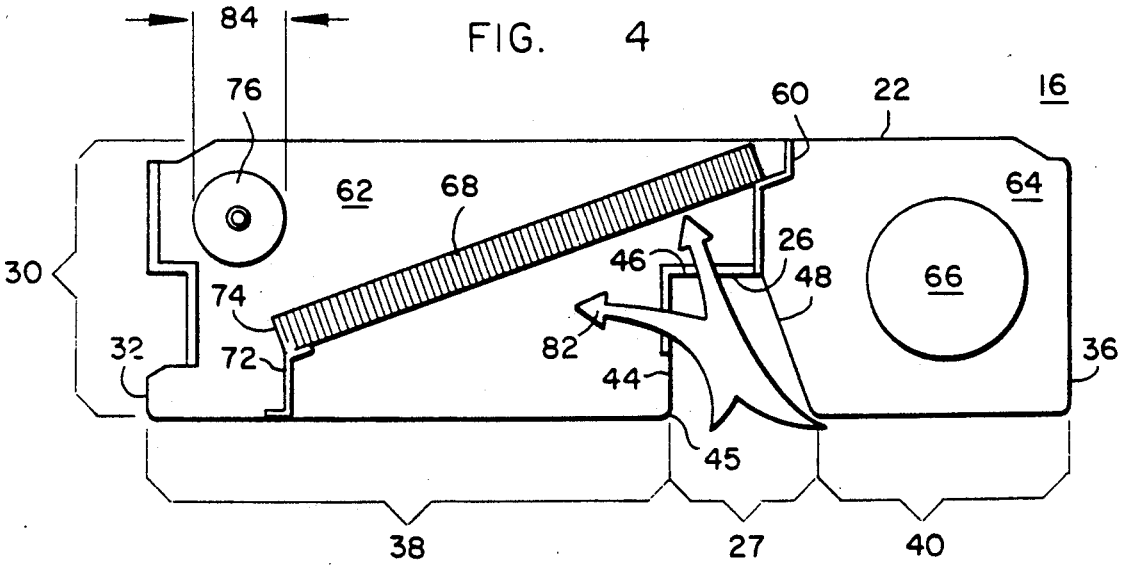
FIG. 4 shows a top view of the arrangement of the outside section of FIG. 2.
Figure 3:
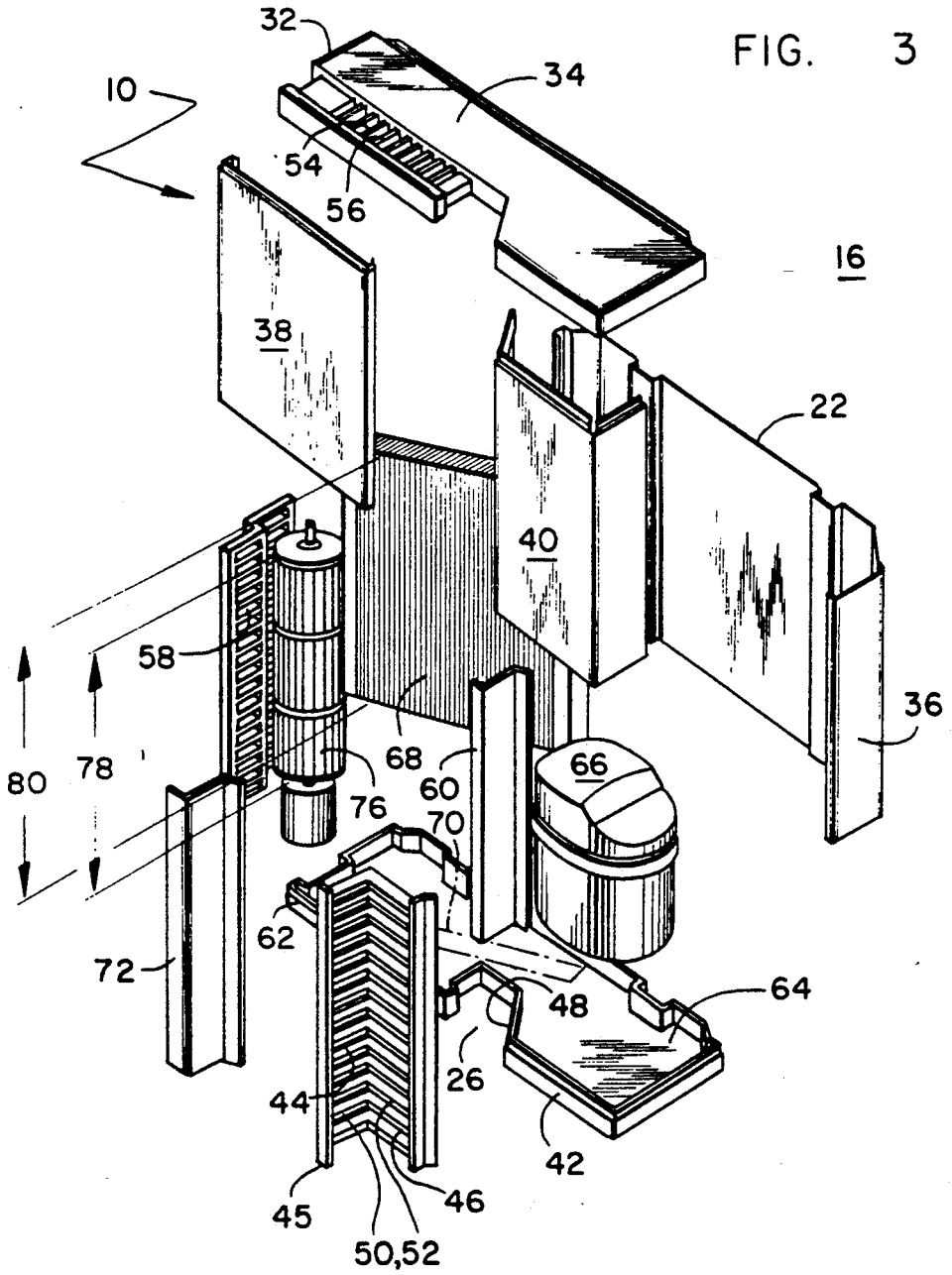
FIG. 3 shows an exploded view of the outside unit of FIG. 2.

Referring to FIGS. 3 and 4, FIG. 3 shows an exploded view of the outdoor section 16. An acoustical baffle 60 divides the interior of the outdoor section 16 into a heat exchange segment 62 and a compressor segment 64. The first portion 38 covers the heat exchange segment 62. The compressor segment 64 is covered by the second portion 40 and contains a compressor 66 which in a cooling mode of operation compresses hot vapor from the indoor section 12 for cooling by a flat heat exchange coil 68, and in a heating mode of operation compresses hot vapor from the outdoor heat exchange coil 68 for cooling by the indoor section 12. The heat exchange coil 68 itself is contained in the heat exchange segment 62 and is arranged on a diagonal path 70 in such a manner that all airflow between the air inlet 26 and the air outlet 30 must pass over the heat exchange coil 68. The heat exchange coil 68, the air inlet 26, and the air outlet 30 are substantially coextensive with a height H of the housing 17. A baffle 72 is provided between an end 74 of the heat exchange coil 68 and the first portion 38 of the front panel 28 so that airflow cannot bypass the heat exchange coil 68. A vertical tangential blower 76 having a height 78 (preferably 15.75 inches or 400 mm) which is approximately the same height as the height 80 of the heat exchange coil 68 is provided between the heat exchange coil 68 and the outlet 30. The blower 76 maintains airflow on an air path through the air inlet 26, over the heat exchange coil 68, through the blower 76, and out the air outlet 30. Although the blower 76 is shown in the preferred embodiment between the air outlet 30 and heat exchange coil 68, the blower 76 can also be located between the air inlet 26 and the heat exchange coil 68. If the optional top air intake 54 is provided, the top air intake 54 opens into the heat exchange segment 62 on the opposite side of the heat exchange coil 68 from the air outlet 30.

FIG. 4 shows a top view of the arrangement of the outdoor section 16. FIG. 4 shows how the baffle 60 isolates the compressor 66 within the compressor segment 64 from the heat exchange coil 68 in the heat exchange segment 62. This baffle 60 acts as an acoustical isolator preventing compressor noise and vibration from reaching the heat exchange coil 68 and being carried into the environment to be cooled by means of the refrigerant conduits 18. The acoustical baffle 60 also closes the compressor segment 64 to airflow. All airflow in the outside section 16 is through the heat exchange segment 62. A double headed arrow 82 shows how airflow enters the air inlet 26 through the sides 44 and 46. The baffles 60 and 62 ensure that this airflow 82 must pass through the heat exchange coil 68 and the fan 76 before being directed out the air outlet 30.

In applicant's preferred embodiment the housing 17 has a height H of 23.7 inches (602 mm) or 33.86 inches (860 mm) depending on capacity, a depth D of 11.3 inches (287 mm), and a width W of 31.89 inches (810 mm) thus providing a width to depth ratio of 2.82 in the preferred embodiment. Previous outside sections have required heights, widths, depths and minimum clearances as shown in Table 1.

TABLE 1

| | (IN MILLIMETERS) | | | | | |
|---|---|---|---|---|---|---|
| | Height | Width | Depth | Width/Depth (No Clearance) | Minimum Clearance | Width/Depth With Clearance |
| Present Invention | 602/860 | 810 | 287 | 2.82 | 0 | 2.82 |
| Example 1 | 461 | 742 | 337 | 2.20 | 50.8 | 1.91 |
| Example 2 | 622 | 464 | 464 | 1.00 | 50.8 | .90 |
| Example 3 | 461 | 742 | 337 | 2.20 | 50.8 | 1.91 |
| Example 4 | 642 | 582 | 582 | 1.00 | 50.8 | .92 |

Additionally, the ratio of the width-to-depth of the housing 17 of the invention is less than 1.25 times the ratio of the depth D of the housing 17 to the diameter 84 (4.92 inches (125 mm) in the preferred embodiment) of the tangential blower 76.

What has been described is the outdoor section of a split system air conditioning unit which can be wall mounted and which has a lower depth profile, and width to depth ratio than previous outside sections.

It should be recognized that modifications and alterations of the present invention as described herein are contemplated, including a side inlet/side discharge arrangement should compressor noise be ignored. All such modifications and alterations are intended to within the spirit and scope of the present invention.

What is desired to be secured by Letters Patent of the United States is claimed as follows:

1. An outside section for a split system air conditioning unit comprising:

a housing including a first side, a second side, a top, a bottom, a front, and a back;

the housing including an air inlet located in a middle portion of the front, and an air outlet located in the first side; and a first baffle dividing the housing interior into first and second segments, wherein the first segment includes the air inlet, the air outlet and a heat exchange coil located therebetween, wherein the second segment includes a compressor operably connected to the heat exchange coil, and wherein the air inlet is a three sided recess where none of the three sides are parallel to any of the other sides of the recess.

2. The outside section of claim 1 further including a tangential blower extending the length of the heat exchange coil and located between the air outlet and the heat exchange coil.

3. The outside section of claim 1 wherein two of said three recessed sides are perpendicular, adjacent, allow airflow, and include louvers.

4. The outside section of claim 1 wherein the air inlet and the air outlet each substantially extend from the top to the bottom of the housing.

5. The outside section of claim 1 wherein the first baffle forms an acoustical barrier between the first and second segments.

6. The outside section of claim 1 further including a second baffle located adjacent the heat exchange coil to preclude airflow between the inlet and the outlet other than through the heat exchange coil.

7. The outside section of claim 1 further including an outside section for a split system air conditioning unit comprising:

a housing including a first side, a second side, a top, a bottom, a front, and a back;

the housing including an air inlet located in a middle portion of the front, a top air intake located in the top of the housing and an air outlet located in the first side; and a first baffle dividing the housing interior into first and second segments.

wherein the first segment includes the air inlet, the air outlet and a heat exchange coil located therebetween, wherein the second segment includes a compressor operably connected to the heat exchange coil.

* * * * *